United States Patent [19]

Wrulich et al.

[11] Patent Number: 4,884,848

[45] Date of Patent: Dec. 5, 1989

[54] DEVICE AND METHOD FOR EXPLOITING MATERIAL

[75] Inventors: Herwig Wrulich, Zeltweg; Hubert Weissensteiner, Knittelfeld; Bernward Bruns, Obdach, all of Austria

[73] Assignee: Voest-Alpine Aktiengesellschaft, Linz, Austria

[21] Appl. No.: 251,706

[22] PCT Filed: Dec. 4, 1987

[86] PCT No.: PCT/AT87/00074

§ 371 Date: Aug. 22, 1988

§ 102(e) Date: Aug. 22, 1988

[87] PCT Pub. No.: WO88/04354

PCT Pub. Date: Jun. 16, 1988

[30] Foreign Application Priority Data

Dec. 5, 1986 [AT] Austria ..... 3251/86
Feb. 17, 1987 [AT] Austria ..... 341/87

[51] Int. Cl.[4] ..... E21C 25/08; E21C 47/00
[52] U.S. Cl. ..... 299/73; 299/75
[58] Field of Search ..... 299/61, 63, 70, 73, 299/75, 76, 78, 80

[56] References Cited

U.S. PATENT DOCUMENTS

| | | | |
|---|---|---|---|
| 3,306,663 | 2/1967 | Webster | 299/61 X |
| 3,420,577 | 1/1969 | Pentith | 299/31 |
| 4,664,449 | 5/1987 | Barnthaler et al. | 299/76 X |
| 4,749,194 | 6/1988 | Schmid | 299/75 X |
| 4,778,221 | 10/1988 | Kolleth et al. | 299/70 |

FOREIGN PATENT DOCUMENTS

| | | | |
|---|---|---|---|
| 2192920 | 1/1988 | United Kingdom | 299/73 |

*Primary Examiner*—Jerome W. Massie
*Assistant Examiner*—David J. Bagnell
*Attorney, Agent, or Firm*—Cushman, Darby & Cushman

[57] ABSTRACT

The openpit mining device includes a cantilever arm which is swivellable around a horizontal axis and carries a support or tool carriage. The support or tool carriage is shiftably supported in a transverse relation to the longitudinal axis of the cantilever arm and has tools rotatably supported on it. For this purpose, the head of the cantilever arm carries a rod-type guide and the tool carriage or support carries a rod-type guide. The guide rods are mutually interconnected with interposition of an intermediate carrier. The shifting drive is provided by hydraulic cylinder-piston-aggregates which are arranged between the intermediate carrier and the head and between the intermediate carrier and the support.

9 Claims, 5 Drawing Sheets

IV
21

DEVICE AND METHOD FOR EXPLOITING MATERIAL

BACKGROUND OF THE INVENTION

1. Field of the Invention

The invention relates to a device for exploiting rock materials, ores, coal or the like, comprising rotating tools being rotatably supported on a cantilever arm which can be lifted and lowered, and relates in particular to an openpit mining device comprising rolls or heads being arranged in transverse relation to the longitudinal axis of the cantilever arm and being equipped with bits.

2. Description of the Prior Art

Such known openpit mining de frequently comprise their own chassis, in particular an endless ground engaging track equipped chassis, and can be moved by an individual drive means. As is the case in connection with underground mining machines, the chassis can have connected thereto a loading equipment oriented in a direction towards material to be excavated and seizing the excavated material and transporting this material onto conveyors. The known openpit mining devices have in common that the cantilever arm is only swivellable around an approximately horizontal axis and thus exclusively in a height direction. In any given position of the machine, its working width is restricted to the width of the excavating tools, and for the purpose of covering a greater width, the openpit mining device must be moved and be brought into a new position. If the known machine were equipped with a plurality of cutting heads or rolls being arranged one beside the other as seen in axial direction, there were frequently used several drive motors, each of which was used to drive a maximum of two rolls arranged one beside the other as seen in direction of the axis of rotation, to be in the position to keep small the distance between adjacent rolls as required for the necessary gearing. However, there remained, when operating such devices, a rock rib between rolls or heads located adjacent as seen in direction of the axis of rotation, which rib was predetermined by the dimensions of the gearing. Therefore, these rock ribs had to be removed or crushed by means of separate tools or scrapers which was varyingly expensive in dependence on the properties of the rock. If, when working with the known device, the support was shifted in the lateral direction during downward cutting work, it was possible to continuously crush the ribs without separate equipment inasfar as the lateral angle of slope was adjusted to be sufficiently flat. Adjustment of steep lateral angles of slope, in particular of lateral slopes having an essentially vertically extending edge, was not easily possible with the known device.

SUMMARY OF THE INVENTION

The invention is based on a device of the initially mentioned type and aims at increasing the workable width of rock to be excavated without moving the device itself and without the necessity to have to increase the propelling power for the rotating tools. The invention aims at providing the possibility to arbitrarily adjust the lateral angle of slope and to cut even vertical lateral slopes without the aid of additional measures. For solving this task, the invention essentially consists in that the rotating tools are supported on a support and in that the support is supported on the cantilever arm for being shiftable in transverse relation to the longitudinal axis of the cantilever arm. On account of the rotating tools being supported on a support itself being supported on the cantilever arm for being shiftable in transverse relation to the longitudinal axis of the cantilever arm, a greater width can be worked upon by shifting the support with the position of the chassis of the device remaining in the same position. It is not necessary to increase the propelling power for the rotating tools.

In this case, the construction is preferably selected such that the free end of the cantilever arm has an enlarged head on which is fixed a guide means for the support. Such an enlarged head reliably makes sure that even high reactive forces are reliably absorbed, and, for the purpose of providing an arrangement being as compact as possible and being capable to resist high reactive forces, the guide means for the support is advantageously formed of rods extending in transverse relation to the longitudinal axis of the cantilever arm and being at least partially embraced by a part of the support. In this manner, there is provided a particularly simple guide means for the shiftablility of the support in transverse direction and simultaneously a reliable supporting means for the reactive forces. In case of greater shifting paths, relatively thick rods would have to be selected in consideration of the high reactive forces to provide for a corresponding stiffness and an exact guiding effect. For the purpose to be in the position to do with component parts of even small size for the guide means in case of greater shifting paths, the arrangement is advantageously selected such that the guide means are supported on the head of the cantilever arm at at least three, preferably four, locations along their axial length.

For reliably supporting the support it is, as already mentioned, advantageous if the guide means are at least partially embraced. On account of the supporting means for the guide means being provided by rods themselves being distributed over the axial length of the guide means, the possible shifting path of the support in transverse relation to the longitudinal axis of the cantilever arm is restricted, because shifting of a component part embracing the guide rods can obviously only be effected between adjacent supporting locations on the head. For the purpose of providing a correspondingly great shifting width in case of a greater number of supporting locations for the guide rods on the head, the arrangement is advantageously such that the guide means are connected with an intermediate carrier, that the intermediate carrier comprises additional guide means for the support and that the intermediate carrier is shiftable relative to the head and the support is shiftable relative to the intermediate carrier by a drive means connected with both respective component parts. Such an intermediate carrier forms some type of telescoping means together with the support and, when providing such an intermediate carrier, the possible shifting width can almost be doubled when compared with the distance of the supporting means for the guide rods.

The drive means for shifting the intermediate carrier and for shifting the support can in a particularly simple manner be formed of cylinder-piston-aggregates, and the reaction forces can reliably be resisted if the intermediate carrier comprises bearing means embracing the guide means of the head and of the support. If the guide means of the head and of the support, respectively, are formed of rods being fixed at sections of their length at the head or the support, respectively, the embracing bearing means of the intermediate carrier can be formed of bearing eyes provided in a bearing plate of the intermediate carrier, through which bearing plate extend the guide means of the head and the support, respectively.

According to the invention, the arrangement is advantageously such that the distances of the bearing means provided on the head, on the support and on the intermediate carrier are approximately the same. For the purpose of providing an exact parallel guide, the guide means on the head and on the support are advantageously formed of rods or tubes arranged in respective pairs within a plane through which extends the longitudinal axis of the cantilever arm. In this case, the bearing means in the intermediate carrier can advantageously be designed such that the guide means of the head and of the support are maintained within mutually parallel planes.

With consideration of the shiftability of the support, the rotating drive means for the rotating tools is advantageously fixed to the support. The additional weight of such a rotating drive means is easily supported on account of the special construction of the bearing means and of the guide means of the component parts.

For the purpose of providing the possibility to accelerate cutting work by means of such a device, it is advantageously intended to keep as small as possible the rock rib remaining between adjacent heads or rolls. For this purpose, a preferred device for performing the process is characterized in that a plurality of separate drive motors is provided for the rotatable heads or rolls. Such a plurality of motors must propel a repective smaller number of rolls or heads, so that the gearing required therefor and being arranged within the carrier arms between adjacent rolls or heads can be given a more narrow construction. In this case, the device is advantageously designed such that one drive motor is provided for each pair of adjacent rolls or heads.

For the purpose of achieving the oscillating movement of the support, the device according to the invention is advantageously further developed such that the shifting drive means for the support is provided double-acting hydraulic or pneumatic cylinder-piston-aggregates, the working chambers of which are connected with a valve assembly, which alternately supplies fluid to the working chambers and opens the just opposite working chamber. In this case, there is advantageously selected a valve assembly of adjustable switching frequency to be in the position to better adapt the advancing speed to the existing rock properties.

For the purpose of delimiting the stroke, the device is advantageously further developed such that limit switches, in particular adjustable limit switches, for switching over the shifting movement of the support are arranged within the shifting path of the support. The limit switches can in a particularly simple manner be adjusted to the width of the rib remaining between adjacent rotating rolls or heads, which width results from the just existing construction.

The device according to the invention comprising rotating tools being rotatably supported on a liftable and lowerable cantilever arm, in particular an openpit mining device having the axes of rotation for rolls or heads equipped with bits arranged in transverse relation to the longitudinal axis of the cantilever arm and having the rotating tools supported on a support and having supported the support for shifting movement in transverse relation to the longitudinal axis of the cantilever arm on the cantilever arm can with advantage be used for a process for excavating of material, in which the shifting drive means of the support is driven to effect a reciprocating movement during advancing the carrier in substantially vertical direction. Such an oscillating movement of the carrier prevents the carrier arranged between adjacent rotating heads or rolls from hitting a rock rib when effecting cutting work in downward direction, because such rock ribs are cut away in time by the oscillating movement of the carrier. In this case, the process is advantageously performed such that the stroke of the reciprocating movement between the reversal points thereof is selected so as to be at least equal the distance between adjacent rolls or heads as measured in the axial direction.

For the purpose of providing the possibility of effecting the cutting work with a relatively great speed and for the purpose of maintaining low the power required for driving the rolls or heads, the process is advantageously performed such that the ratio of the advancing speed in a vertical direction to the stroke frequency of the support is selected so as to be smaller than the height of the rib or equal this rib. In this manner, a rib just formed between adjacent heads or rolls is always cut away in time prior to any possible collision with the carrier arm of the rolls or heads, and this even in that case in which an essentially vertical slope is cut or hewn. For flatter angles of slope, the advancing speed may, of course, be increased, noting that the advancing speed is, in this case, not selected in exactly vertical direction but in diagonal direction. For this purpose, a lateral shifting movement of the support is superimposed to the oscillating movement of the support.

The process according to the invention can, in principle, be performed with any type of the described device case of special arrangements, it will be necessary to incorporate a corresponding valve assembly for the oscillating drive means of the support. When effecting cutting work in an essentially vertical direction, the great lateral adjusting paths, which would be possible with a telescopically interengaging guide means of the support, are not imperative, because, in this case, only an oscillating movement is required which corresponds to the rock rib remaining between adjacent rolls or heads. The stroke required therefor is relatively small, so that substantial adjustability is not required. A substantial adjustability in the lateral direction in combination with the oscillating movement of the support provides, however, the possibility to adjust any desired angles of slope and to effect a better adaptation to differing rock properties with a minimum of power consumption.

BRIEF DESCRIPTION OF THE DRAWINGS

The invention is now further illustrated with reference to examples of embodiment shown in the drawings. In the drawings:

FIG. 5 shows a top plan view analogous to that of FIG. 2 in a first shifted position, while

DETAILED DESCRIPTION OF THE DRAWINGS

Figure 1:
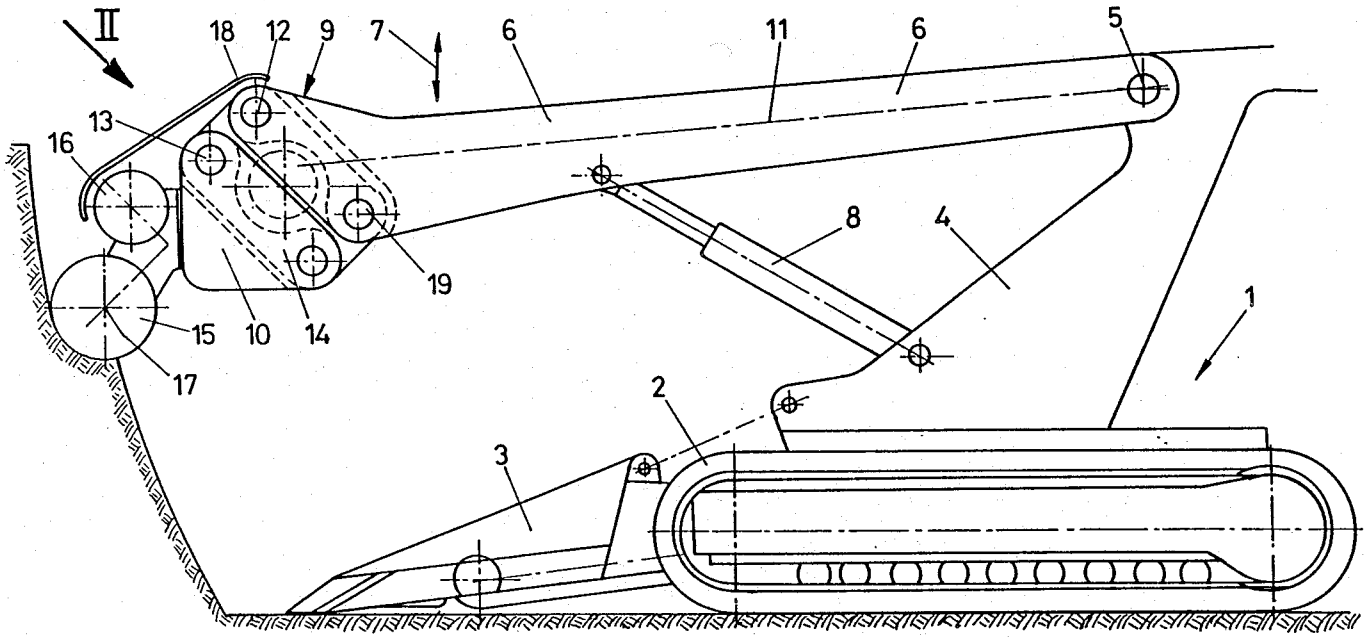
FIG. 1 shows a side elevation of an openpit mining device according to the invention.

In FIG. 1, there is shown an openpit mining device 1 which can be moved along the floor by means of an endless ground-engaging track equipped chassis 2. Furthermore, the openpit mining device 1 has a loading means 3 by means of which excavated material resting on the floor or ground, respectively, can be picked up and transported, away. A superstructure 4 is connected with the tracked chassis and comprises a cantilever arm 6 being swivellable around an essentially horizontal axis 5. In the embodiment shown, the cantilever arm 6 can only be swivelled in height direction in the sense of the twin arrow 7, for which purpose there is provided a supporting and swivelling cylinder 8.

A support or tool carriage 10, respectively, is shiftably supported on the head 9 of the cantilever arm 6. The direction of shifting movement is oriented in transverse relation to the longitudinal axis 11 of the cantilever arm. For this shifting movement, there are provided guide means 12 on the head 9 and guide means 13 on the carriage, these guide means being embraced by an intermediate carrier 14.

The tool carriage or support 10, carries the excavating tools 15 and the drive motor 16 for rotating the excavating tools around an axis 17 which is oriented in a transverse relation to the longitudinal axis 11 of the cantilever arm. The guide means for the support or tool carriage 10, is covered by a cover plate 18. In the representation according to FIG. 2, this cover plate 18 has been removed.

Figures 2, 3, 4:
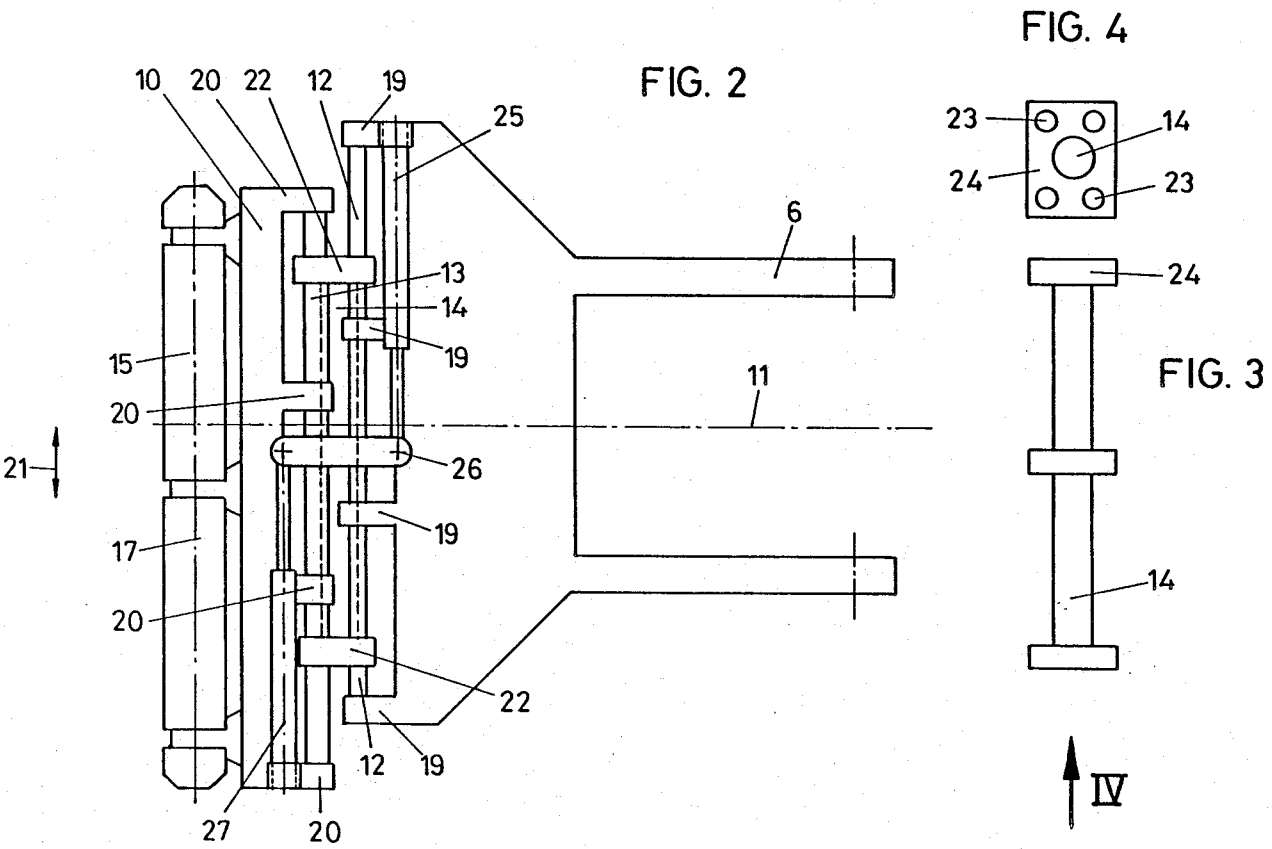
FIG. 2 shows a view in direction of the arrow II of FIG. 1 with the cover plate being removed.
FIG. 3 shows a top plan view of an intermediate carrier in correspondence with the view shown in FIG. 2.
FIG. 4 shows a view of the intermediate carrier in direction of the arrow IV of FIG. 3.
Figure 5:
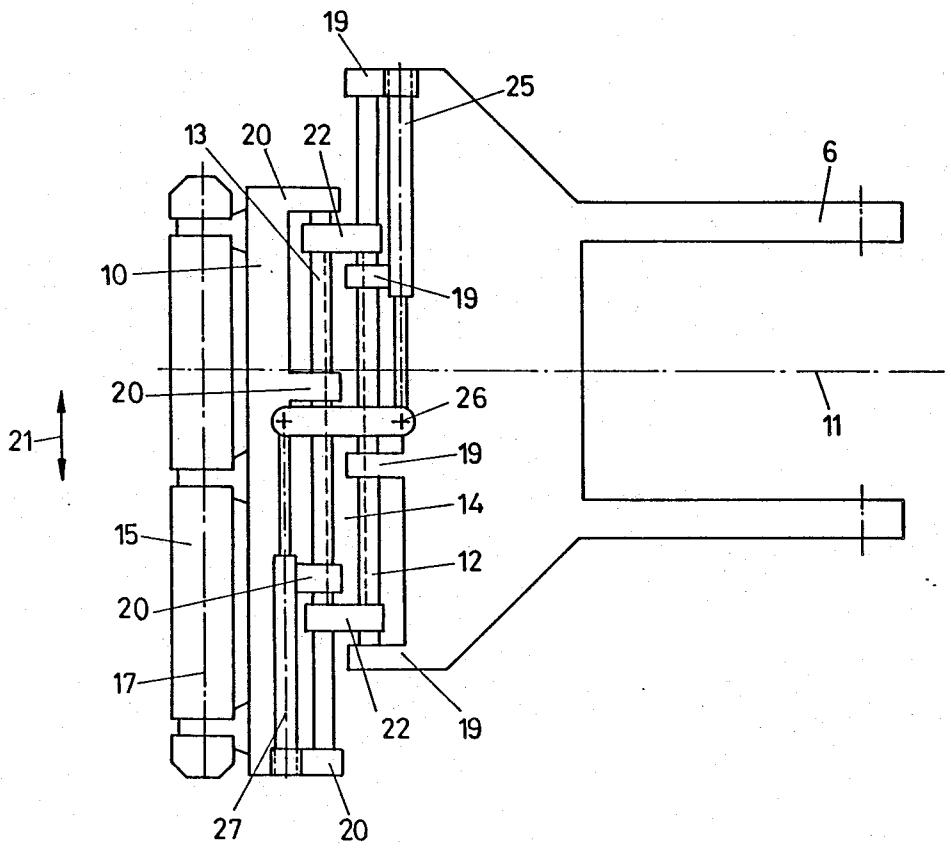
Figure 6:
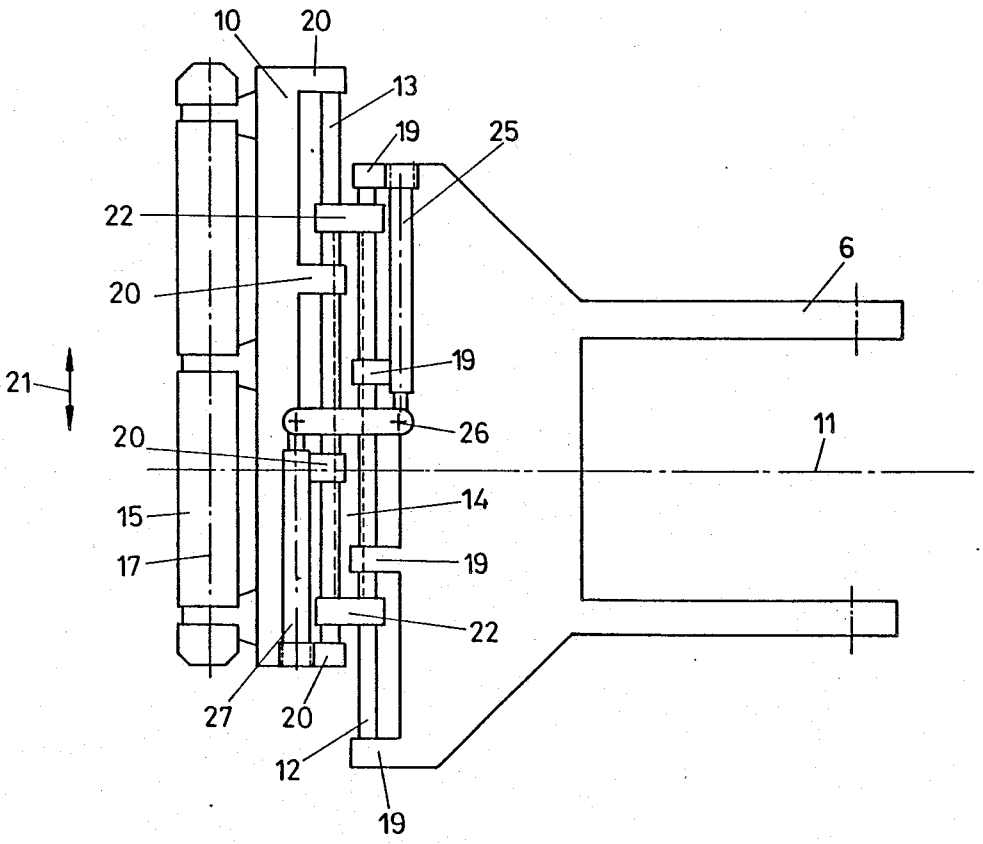
FIG. 6 shows an analogous top plan view as FIG. 5 in a second shifted position of the support.

FIG. 2 shows that guide rods 12 are fixed to the head 9 of the cantilever arm 6. The guide rods 12 are supported in bearing eyes 19, which bearing eyes 19 are rigidly connected with the head 9. Four of such bearing eyes 19 are distributed along the axial length of the guide rods 12 of the head and embrace the guide rods 12. Also, the support or tool carrier 10, comprises analogous bearing eyes 20 which embrace the guide rods 13 of the support 10. The distance between adjacent bearing points or bearing eyes 20 or 19, is essentially the same. In a construction, in which the bearing eyes 20 would immediately cooperate with the rods 12 of the head, there would result a maximum shifting path corresponding to the distance of adjacent bearing eyes 19 and 20, as measured in axial direction of the rods 12 and 13, respectively. For the purpose of increasing the shifting path of the tool 15 in the direction of the twin arrow 21, there is now provided an intermediate carrier 14 embracing with bearing eyes 22 the rods 12 as well as the rods 13. The intermediate carrier 14 comprises three plates carrying such bearing eyes and is shown in greater detail in the FIGS. 3 and 4. The bearing eyes embracing the guide rods 12 and 13 are, in this case, formed of bores 23 provided in supporting plates 24 of the intermediate carrier 14 as is shown in FIG. 4. The distances of the bores 23 forming the bearing eyes for the rods 12 and 13 are designed such that the support 10 is parallely guided relative to the head. By providing such an intermediate carrier 14, there results a type of telescoping arrangement which increases the maximum shifting path in a direction of the twin arrow 21. For this purpose, there is provided a hydraulic cylinder-piston-aggregate 25 between the head 9 and a bearing plate 24 of the intermediate carrier, the connecting point on the intermediate carrier being designated by 26. A second hydraulic cylinder-piston-aggregate 27 connects the intermediate carrier 14 with the support or tool carriage 10. By actuating both hydraulic cylinder-piston-aggregates 25 and 27 there can, as is schematically represented in the FIGS. 5 and 6, now be obtained relatively great adjusting paths in the direction of the twin arrow 21. In FIG. 5, both hydraulic cylinder-piston-aggregates 25 and 27 have been extended, which results in shifting the tool carrier for approximately twice the distance of adjacent bearing points for the guide rods 12 on the head and, respectively, of adjacent bearing points 13 on the tool carriage or support 10. By retracting the hydraulic cylinder-piston-aggregates 25, 27, there can be assumed the position more clearly shown in FIG. 6. In this case, the support 10 is again shifted relative to the head 9. Approximately twice the distance of adjacent bearing points 19 on the head and, 20 on the support or tool carrier 10 results for the shifting path.

Figure 7:
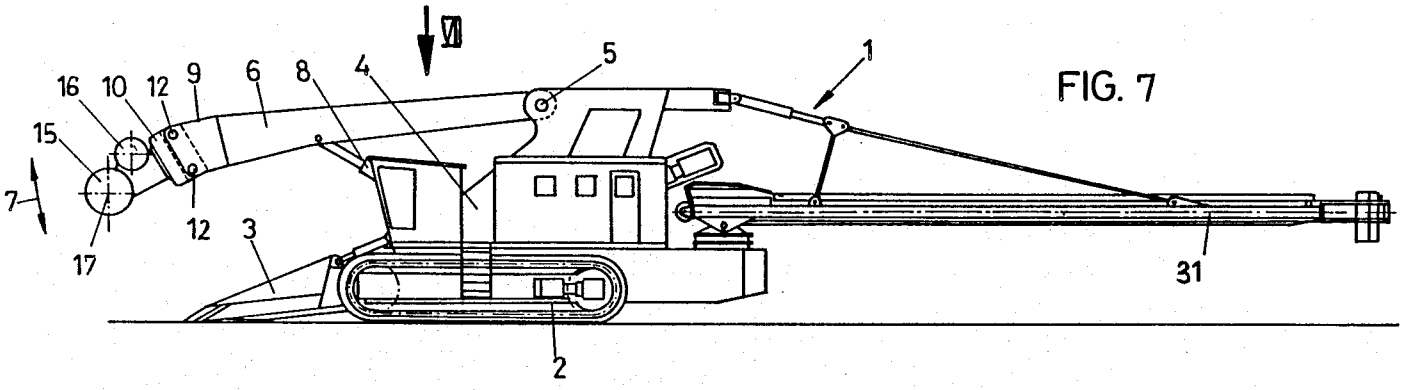
FIG. 7 shows in a side elevation a second embodiment of a device according to the invention.

In FIG. 7, there is again shown an openpit mining device 1, in which the reference numerals of FIG. 1 are again used. The openpit mining device according to FIG. 7 can be moved on floor by means of an endless ground-engaging track equipped chassis 2 and has a loading means 3 by means of which excavated material resting on the floor or ground, can be picked up and removed. A superstructure 4 is connected with the tracked chassis and comprises a cantilever arm 6 which is swivellable around an essentially horizontal axis 5. The cantilever arm 6 can only be swivelled in height direction in the sense of the twin arrow 7, for which purpose there are provided supporting and swivelling cylinders 8, respectively.

A support or tool carriage 10, is shiftably supported on the head 9 of the cantilever arm. The direction of shifting movement extends in a transverse relation to the longitudinal axis of the cantilever arm 6. Guide means 12 are provided on the head 9 of the cantilever arm for shifting the support 10 in an essentially horizontal direction.

The tool carriage or support 10, carries the excavating tools 15. A plurality of such excavating tools is arranged one beside the other in the direction of the axis 17 of rotation. Motors 16 are provided for driving the excavating tools.

Figure 8:
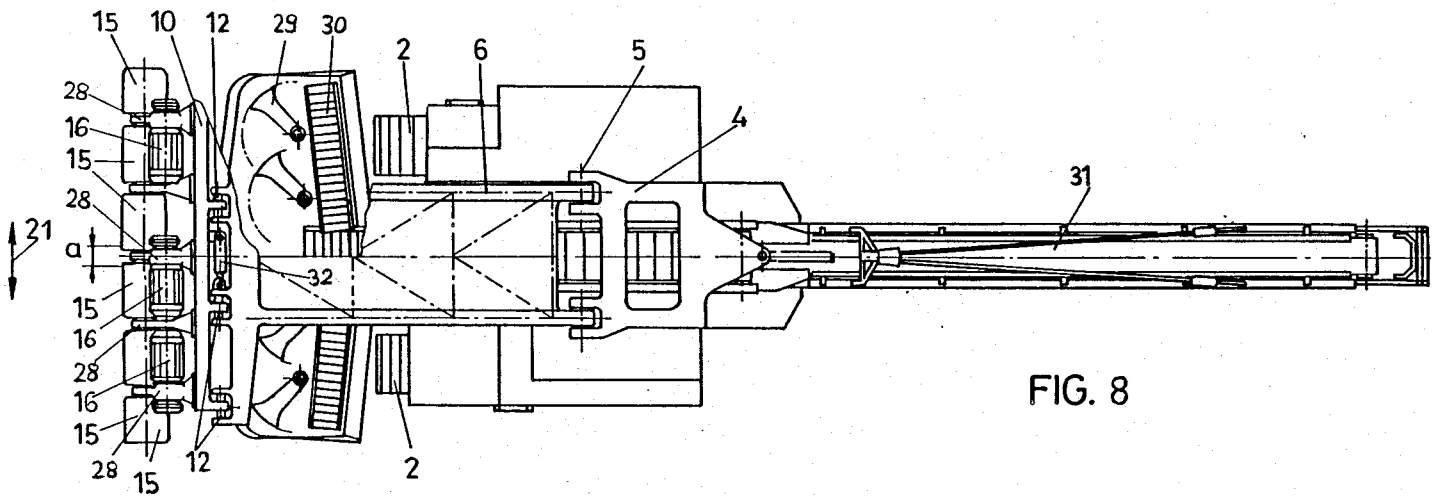
FIG. 8 shows a top plan view in the direction of the arrow VII of FIG. 7.

As can be understood from the top plan view shown in FIG. 8, two cutting rolls are in pairs driven by common drive motors 16 for being rotated. The drive motors 16 are effective with interposition of gearing 28. The gearing 28 is located in the bearing arms of the rolls 15 and on account of a plurality of drive motors 16 being provided, these bearing arms can be given a relatively small size in the direction of the axis 17 of rotation for the tools, because driving torque need only be transmitted in each case for only two rolls.

From the representation according to FIG. 8, there can be recognized four seizing arms 29 on the loading means 3, by means of which seizing arms the excavated material is fed to a removal means 30 and to a removal means 31 arranged essentially centrally of the machine and transporting the material in longitudinal direction of the machine.

The support 10 is driven by a hydraulic cylinder-piston-aggregate 32 to effect an oscillating movement in the sense of the twin arrow 21. The stroke of this oscillating movement is at least equal the distance a, which is required between adjacent rolls or heads for the gearing of the drive means. When effecting cutting work in an essentially vertical direction in correspondence with the twin arrow 7 of FIG. 7, the rock rib remaining between adjacent rolls 15 is cut away on account of the reciprocating movement of the support 10, so that even steep lateral slope angles can be cut without the assistance of additional equipment for removing the rock rib.

If flatter slope angles are adjusted, a directional shifting movement of the carrier in the sense of twin arrow 21 can be effected simultaneously with the reciprocating movement of the carrier or support 10. However, for this purpose the required shifting path is greater than would be possible with a device to the FIGS. 7 and 8. Such greater shifting paths can, for example, be achieved with a device according to the FIGS. 2, 5 and 6.

What is claimed is:

1. A device for exploiting rock material, comprising:

a chassis;

a cantilever arm having one end pivotally mounted on the chassis by a swivel joint, for swivelling about a horizontal axis transverse to the length direction of the arm, said arm also having a free end;

means connecting between said chassis and said arm for swivelling said arm about said swivel joint;

said free end of said arm mounting a head which is broader than said arm;

a plurality of rotary excavating tools arranged in a series extending transversally of said arm and arranged to rotate about horizontal axes extending transversally of said arm, said excavating tools being equipped with excavator bits;

means supporting said rotary excavating tools on said head of said arm for vertical swivelling movement with said arm about said swivel joint;

said supporting means providing for selective shifting of said rotary excavating tools transversally of said length direction of said arm, by including:

a tool carrier on which said rotary excavating tools are mounted for rotation;

said tool carrier having at least three bearing eyes spaced therealong transversally of said arm;

at least three bearing eyes provided on said head and spaced therealong transversally of said arm;

an intermediate carrier having two sets of at least two bearing eyes;

the bearing eyes of the tool carrier mounting a guide rod on which one set of the bearing eyes of the intermediate carrier are received for sliding movement transversally of the arm;

the bearing eyes of the head mounting a guide rod on which the other set of the bearing eyes of the intermediate carrier are received for sliding movement transversally of the arm;

said bearing eyes of said tool, said bearing eyes of said head, and said bearing eyes in each set on said intermediate carrier all being spaced approximately equal distances apart transversally of said arm;

first means mounted between the intermediate carrier and the head for sliding the intermediate carrier transversally of the arm; and second means mounted between the tool carrier and the intermediate carrier for sliding the tool carrier transversally of the arm.

2. The device of claim 1, wherein:

said first and second means for sliding are constituted by respective extensible and contractible pressurized fluid-operated piston and cylinder aggregates.

3. The device of claim 2, further including:

valve means and switching means associated in operative relationship with said piston and cylinder aggregates for causing said rotating excavating tools, while rotating, to be shifted alternatively leftwardly and rightwardly on said head.

4. The device of claim 1, further including:

rotating drive means for the rotary excavating tools, said rotary drive means being mounted on said tool carrier.

5. The device of claim 4, wherein:

said rotating drive means comprises a plurality of separate drive motors.

6. The device of claim 5, wherein:

said rotary excavating tools are arranged in pairs; and said separate drive motors include one for each pair of said rotary excavating tools.

7. A method for exploiting rock material from a face of a mine, comprising:

providing a plurality of rotating excavating tools on a free end of a cantilever arm, so that the tools are spaced transversally of the length of the arm and rotate about horizontal axes while being supported from at least three transversally spaced sites on the free end of the arm and three transversally spaced sites on a tool carrier for the rotating tools, via three spaced sites on an intermediate carrier laterally shiftably connected between the tool carrier and the free end of the arm; and while swivelling the arm vertically so as to raise and lower the rotating tools in contact with the face of the mine, reciprocating the rotating tools alternately leftwardly and rightwardly relative to the free end of the cantilever arm.

8. The method of claim 7, wherein:

the rotating tools are spaced from one another transversally of the length of the arm and the rotating tools, in being reciprocated leftwardly and rightwardly, are shifted a distance which is at least as great as the distance between adjacent ones of said rotating tools.

9. The method of claim 8, wherein:

between successive periods of reciprocation of said rotating tools, said rotating tools are advanced towards the mine face by a distance which is no greater than said distance between adjacent ones of said rotating heads.

* * * * *